US008030855B2

(12) United States Patent
Lu et al.

(10) Patent No.: US 8,030,855 B2
(45) Date of Patent: Oct. 4, 2011

(54) SINGLE-STAGE ELECTRONIC BALLAST FOR A FLUORESCENT LAMP

(75) Inventors: Hung-Ching Lu, Taipei (TW); Te-Lung Shih, Taipei (TW)

(73) Assignees: Tatung Company, Taipei (TW); Tatung University, Taipei (TW)

( * ) Notice: Subject to any disclaimer, the term of this patent is extended or adjusted under 35 U.S.C. 154(b) by 453 days.

(21) Appl. No.: 12/285,197

(22) Filed: Sep. 30, 2008

(65) Prior Publication Data

US 2009/0289574 A1 Nov. 26, 2009

(30) Foreign Application Priority Data

May 20, 2008 (TW) ..... 97118652 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/247; 315/307

(58) Field of Classification Search ..... 315/209 R, 315/219, 247, 291, 307

See application file for complete search history.

(56) References Cited

U.S. PATENT DOCUMENTS

| | | | | |
|---|---|---|---|---|
| 6,107,750 | A * | 8/2000 | Moisin | 315/219 |
| 2008/0007184 | A1 * | 1/2008 | Van Der Voort et al. | 315/246 |

* cited by examiner

*Primary Examiner* — Anh Tran

(74) *Attorney, Agent, or Firm* — Bacon & Thomas, PLLC

(57) ABSTRACT

The invention provides a single-stage electronic ballast for a fluorescent lamp, comprising a boost circuit and a load unit. The boost circuit includes a first inductor, a first capacitor, a first diode and at least a switch, wherein the positive terminal of the first diode is connected to the first inductor, and the negative terminal of the first diode is connected to the at least a switch. The load unit includes at least a fluorescent lamp, two terminals of the first capacitor are respectively connected to the at least a load unit, and the at least a switch is connected to the load unit for controlling its turning-on and turning-off, wherein the boost circuit and the load unit share the at least a switch.

10 Claims, 10 Drawing Sheets

SINGLE-STAGE ELECTRONIC BALLAST FOR A FLUORESCENT LAMP

BACKGROUND OF THE INVENTION

1. Field of the Invention

The invention relates to the technical field of electronic ballast for a fluorescent lamp, in particular to a single-stage electronic ballast for a fluorescent lamp.

2. Background of the Invention

The design of a conventional electronic ballast for a fluorescent lamp makes use of a set of electronic ballast to drive a single fluorescent lamp tube. However, when there is a need to drive a plurality of fluorescent lamp tubes, the design of using a set of electronic ballast to drive a single fluorescent lamp tube will result in much complicated circuit architecture and too large volume. Therefore, the existing electronic ballast technique for the fluorescent lamp is developed with the tendency of using a set of the electronic ballast to drive a plurality of fluorescent lamp tubes. FIG. 1 shows a circuit structure of a conventional two-stage electronic ballast for a fluorescent lamp, in which at a first stage, a boost-typed converter 101 serves as a power factor correction circuit, and at a latter stage, a class D resonant inverter 103 is used for driving a fluorescent lamp tube. Such a circuit structure of the electronic ballast for a fluorescent lamp is mainly adopted at present.

However, it can be found from FIG. 1 that for a two-stage electronic ballast, two sets of control circuits are required to respectively drive the converter 101 and the inverter 103, and three switch elements are needed, causing complicated circuit, big switching loss and low efficiency.

Hence, there are several defects in the conventional electronic ballasts for the fluorescent lamp which need overcome.

SUMMARY OF THE INVENTION

The invention is intended to provide a single-stage electronic ballast for a fluorescent lamp so as to overcome the problem of the complicated circuit structure encountered in the conventional two-stage electronic ballast for a fluorescent lamp, and the problem of the circuit transformation in low efficiency encountered in the conventional technique.

To accomplish the above-mentioned objective, the invention provides a single-stage electronic ballast for a fluorescent lamp, comprising a boost circuit and a load unit. The boost circuit includes a first inductor, a first capacitor, a first diode and at least a switch, the positive terminal of the first diode is connected to the first inductor, and the negative terminal of the first diode is connected to the at least a switch. The load unit includes at least a fluorescent lamp, two terminals of the first capacitor are respectively connected to the at least a load unit, and the at least a switch is connected to the load unit for controlling its turning-on and turning-off, wherein the boost circuit and the load unit share the at least a switch.

DETAILED DESCRIPTION OF THE INVENTION

The way of implementing the invention will be interpreted through the particular embodiments such that people having the common knowledge in the technical field of the invention will easily understand advantages and effects of the invention from the contents of the specification of the application.

Figure 2:
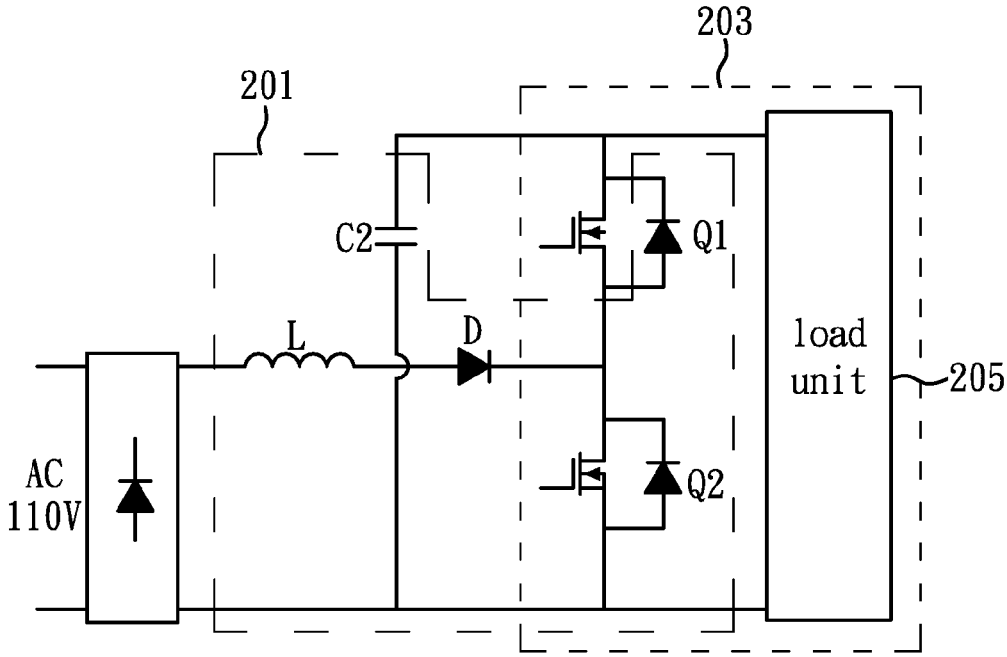
FIG. 2 is a circuit diagram of a single-stage electronic ballast for a fluorescent lamp according to the invention.

FIG. 2 is a circuit diagram of a single-stage electronic ballast for a fluorescent lamp according to the invention. The single-stage electronic ballast for a fluorescent lamp of the invention comprises a boost converter 201 and a class D resonant inverter 203, wherein the boost converter 201 includes an inductor L, a capacitor C, a diode D and two switches Q1 and Q2, the positive terminal of the diode D is connected to the inductor L, the negative terminal of the diode D is connected to the switches Q1 and Q2, and the class D resonant inverter 203 includes the switches Q1 and Q2 and a load unit 205. The load unit 205 includes a plurality of fluorescent lamps. Two terminals of the capacitor C is connected to the load unit 205. The switches Q1 and Q2 are connected to the load unit 205 for controlling its turning-on and turning-off. The boost converter 201 and the load unit 205 share the switches Q1 and Q2.

Figure 1:
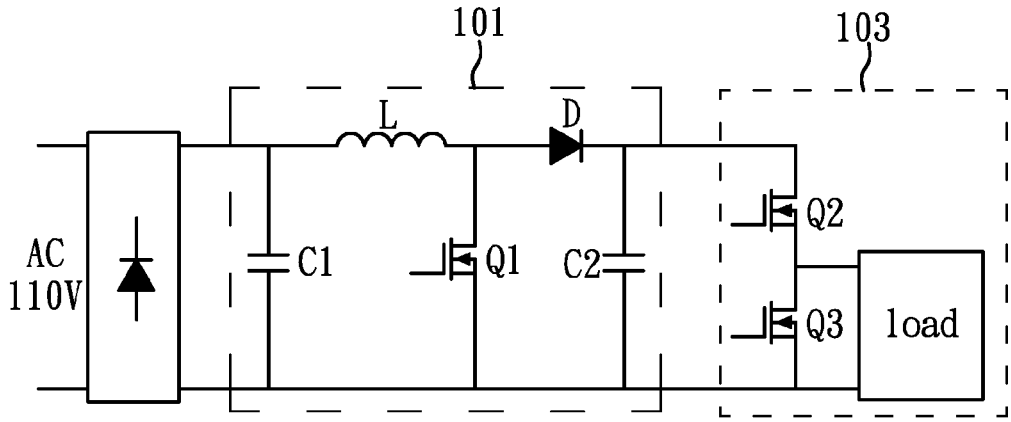
FIG. 1 (Prior Art)
FIG. 1 is a circuit structure diagram of a conventional two-stage electronic ballast for a fluorescent lamp.

In order to overcome the drawback of the circuit architecture of the conventional two-stage electronic ballast for a fluorescent lamp, as shown in FIG. 2, the invention integrates the two-stage electronic ballast for a fluorescent lamp as shown in FIG. 1 into a single-stage electronic ballast for a fluorescent lamp, i.e. integrating the switch of the converter and the lower arm switch of the inverter into one for sharing. Such a structure is capable of saving a set of the control circuit and a switch, thereby simplifying the circuit complexity and raising efficiency.

Figure 3:
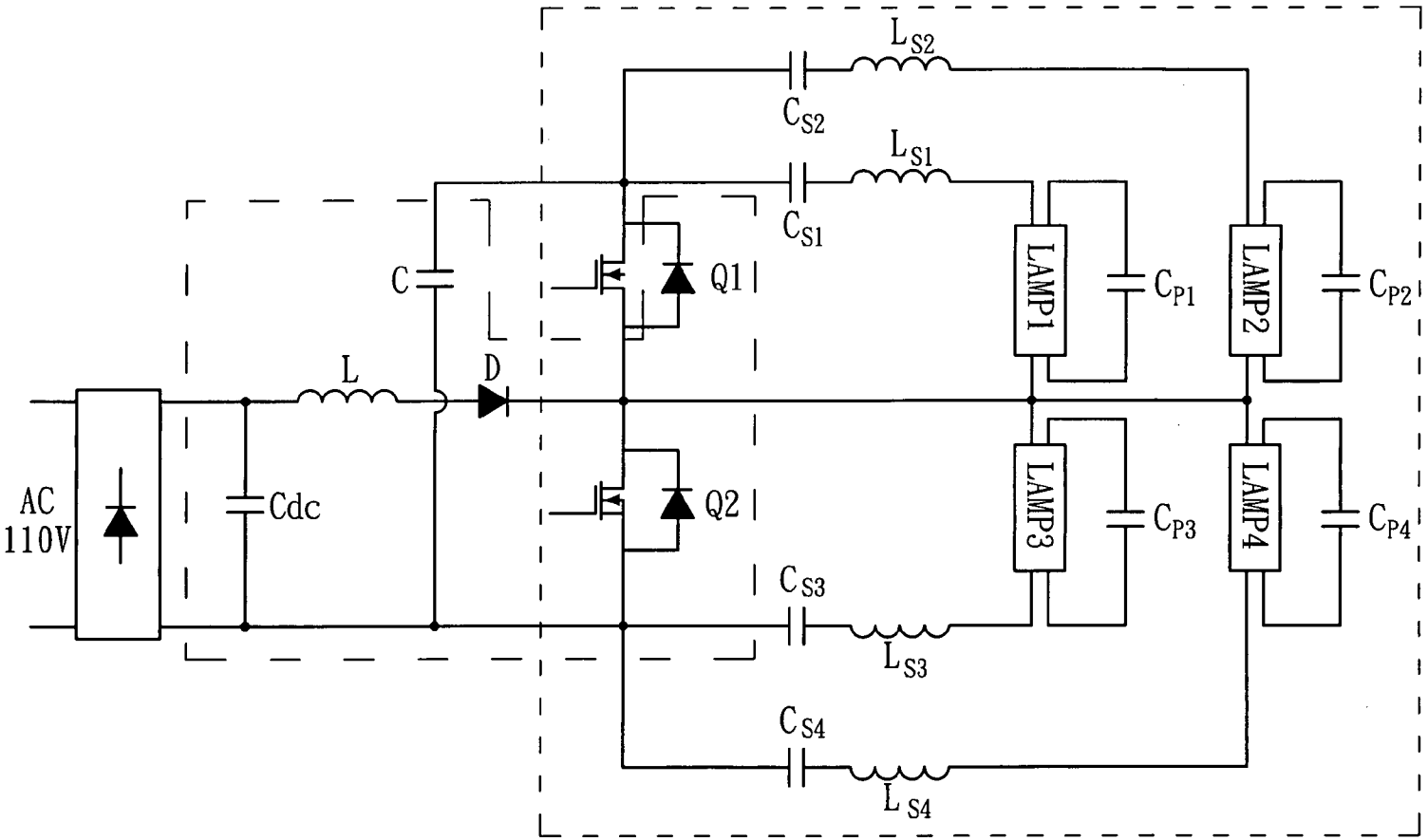
FIG. 3 is further a circuit diagram of a single-stage electronic ballast for a fluorescent lamp according to the invention.

The single-stage electronic ballast for a fluorescent lamp of the invention can be used to drive a plurality of fluorescent lamp tubes. FIG. 3 is a circuit diagram of a single-stage electronic ballast for driving four fluorescent lamp tubes according to the invention.

Figure 4:
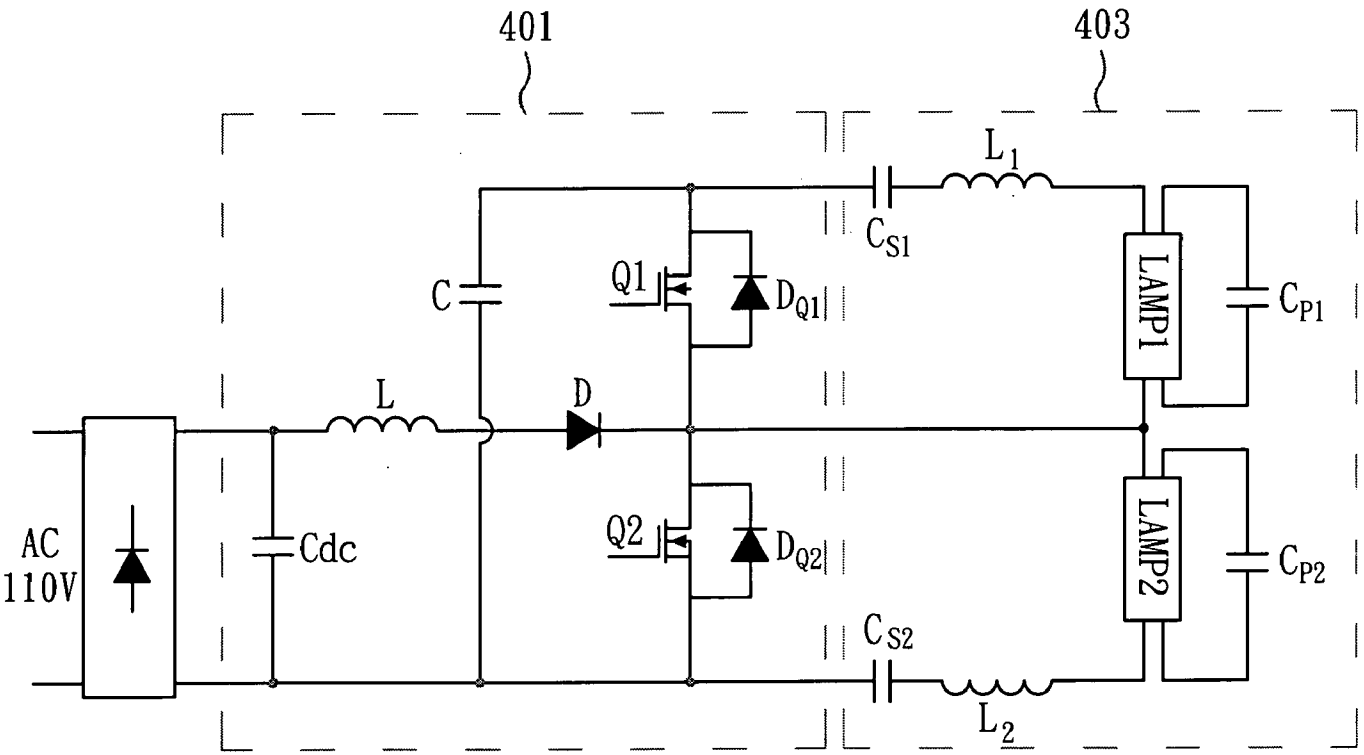
FIG. 4 is further another circuit diagram of a single-stage electronic ballast for a fluorescent lamp according to the invention.

To explicitly analyze the operation of the single-stage electronic ballast for a fluorescent lamp of the invention, FIG. 4 is exampled to interpret how the single-stage electronic ballast for a fluorescent lamp of the invention is used to drive two fluorescent lamp tubes. As shown in the drawing, the single-stage electronic ballast for driving two fluorescent lamp tubes comprises a boost circuit 401 and a load unit 403. The boost circuit 401 includes a DC capacitor Cdc, an inductor L, a capacitor C, a diode D and two switches Q1 and Q2. The load unit 403 includes a capacitor CS1, a capacitor CS2, an inductor L1, an inductor L2, a fluorescent lamp tube Lamp 1, a fluorescent lamp tube Lamp 2, a capacitor CP1, and a capacitor CP2. The positive terminal respectively of the capacitor CS1 and capacitor CS2 is connected to the switches Q1 and Q2, respectively. The negative terminal respectively of the capacitor CS1 and capacitor CS2 is connected to the inductor L1 and inductor L2, respectively. One terminal respectively of the inductor L1 and inductor L2 is connected to the capacitor CS1 and capacitor CS2, respectively. The other terminal respectively of the inductor L1 and inductor L2 is connected to the fluorescent lamp tube Lamp 1 and fluorescent lamp tube Lamp 2. One terminal respectively of the fluorescent lamp tube Lamp 1 and fluorescent lamp tube Lamp 2 is connected to the inductor L1 and inductor L2, respectively. The other terminal respectively of the fluorescent lamp tube Lamp 1 and fluorescent lamp tube Lamp 2 is connected to the switches Q1 and Q2. The switches Q1 and Q2 are connected to a half-bridged, pulse width modulation controller (not shown in the drawing). The half-bridged, pulse width modulation controller produces a pulse width modulation signal to control the switches Q1 and Q2. Each of the switches Q1 and Q2 is preferably a transistor switch, such as a Metal Oxide Semiconductor Field Effect Transistor (MOSFET). With the use of diodes DQ1 and DQ2 provided respectively between the source and drain of the switches Q1 and Q2, the switches Q1 and Q2 may serve as a bi-directional switch, thereby requiring no diode in parallel and thus simplifying the circuit structure.

To simplify analysis, it is explained as below by analyzing the situation of two fluorescent lamp tubes, while basing on the following assumptions:

(1) All switching elements are ideal ones, i.e. being in a short-circuit condition when turning-on and in an open condition when turning-off.

(2) The DC capacitor is large enough such that the filtered current may be deemed as a DC voltage current, while ignoring the ripple.

(3) The frequency of the power source is far smaller than the switching frequency. Hence, in each duty cycle, the input voltage may be deemed as having a constant value.

(4) The switching frequency of the switches is bigger than the resonant frequency. The resonant circuit exhibits an inductive load and the resonant current lags the output voltage of the inverter.

(5) The fluorescent lamp tube is deemed in an open circuit before lighting and in a resistive load after lighting and getting stable.

(6) The quality factor of the load of the resonant circuit is high enough such that the resonant current may be deemed having a sine wave.

Figure 5:
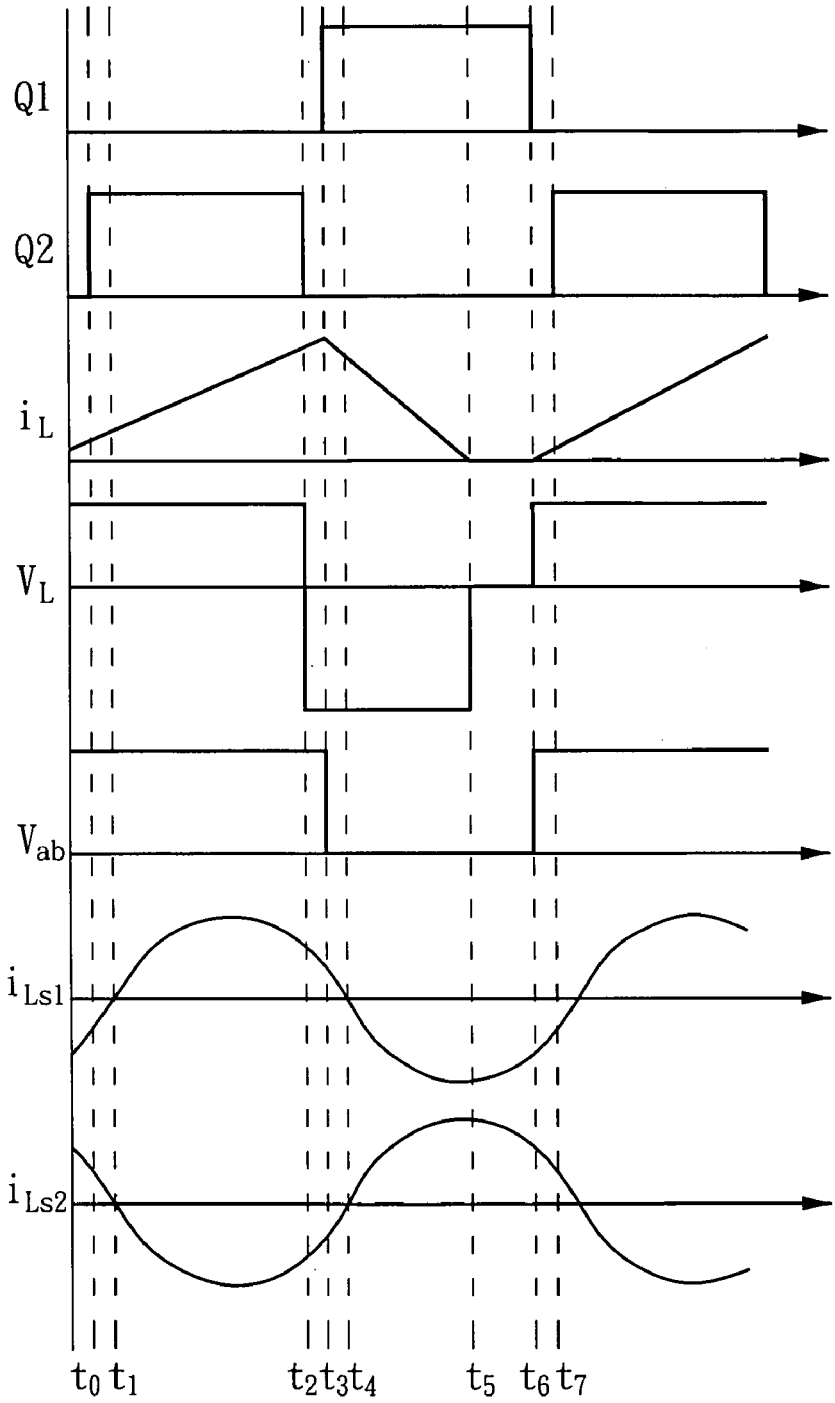
FIG. 5 is a wave-shape diagram of the single-stage electronic ballast for a fluorescent lamp shown in FIG. 4.
Figure 6:
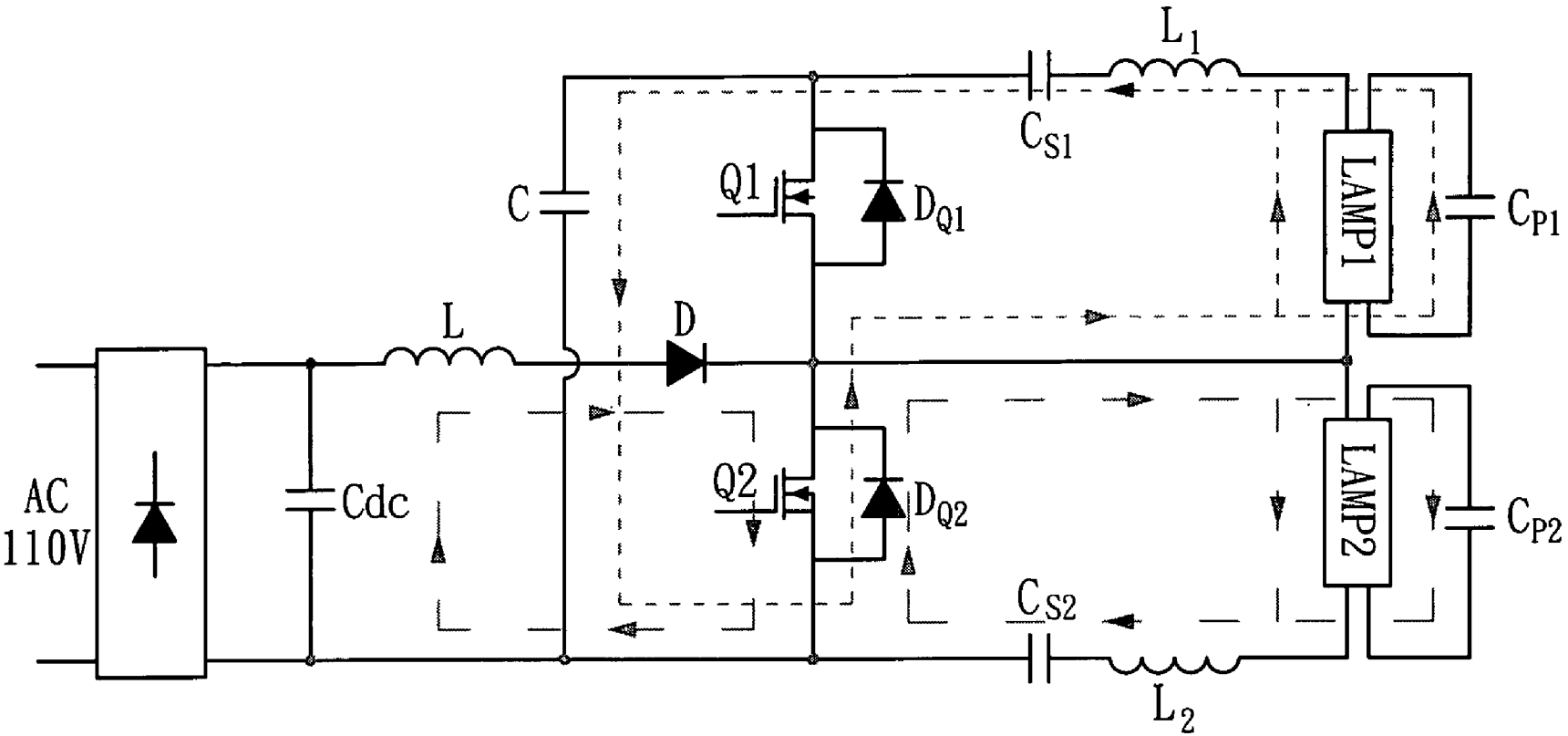
FIG. 6 is a circuit diagram of the invention in working mode 1.

From the conduction states of the switches, the duty cycles of the circuit in high frequency may be divided into five working modes. FIG. 5 is a wave-shape diagram of the single-stage electronic ballast for a fluorescent lamp illustrated in FIG. 4, showing the theoretical wave shapes of voltages and currents in different working modes. The operational principle of the circuit in each working mode will be explained as follows:

Working mode 1 (t0-t1):

FIG. 6 is a circuit diagram of the invention in working mode 1. As shown in FIG. 6, the switch Q2 is conductive in t0, and the switch Q1 and DQ1 are cut off. The input current passes the switch Q2 to charge the inductor L, and iL rises linearly from zero and stops rising when the switch Q2 is cut off.

Power factor circuit: VCdc(+)→L→D→Q2→VCdc(−).

Resonant circuit 1: VC(−)→Q2→(Lamp 1//CP1)→L1→CS1→VC(+).

Resonant circuit 2: L2→CS2→DQ2→(Lamp 2//CP2).

Figure 7:
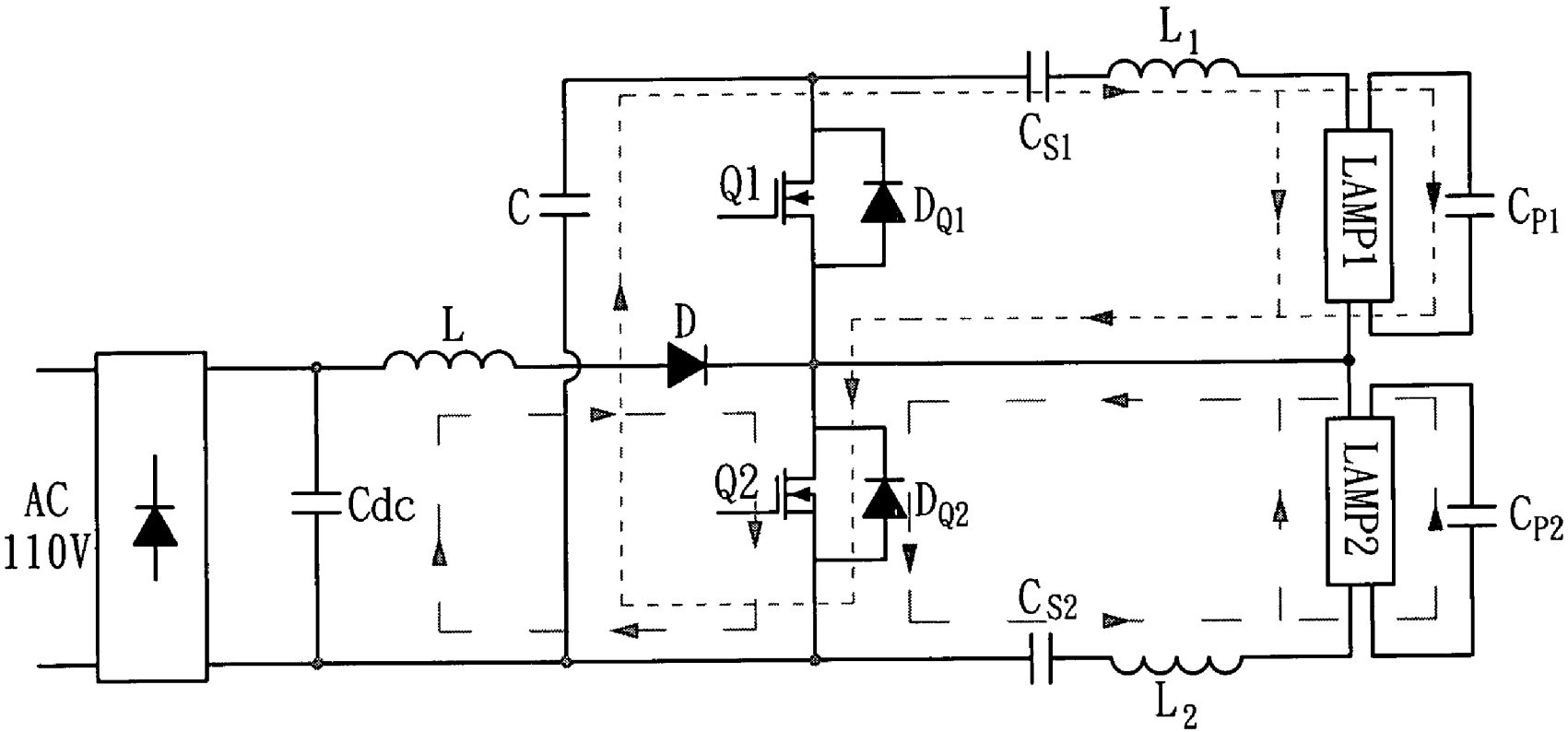
FIG. 7 is a circuit diagram of the invention in working mode 2.

Working mode 2 (t1 to t2):

FIG. 7 is a circuit diagram of the invention in working mode 2. As shown in FIG. 7, the switch Q2 is conductive, the input voltage continues charging the inductor L and two sets of resonant currents pass the switch Q2 to form a circuit.

Power factor circuit: VCdc(+)→L→D→Q2→VCdc(−).

Resonant circuit 1: VC(+)→L1→CS1→(Lamp 1//CP1)→Q2→VC(+).

Figure 8:
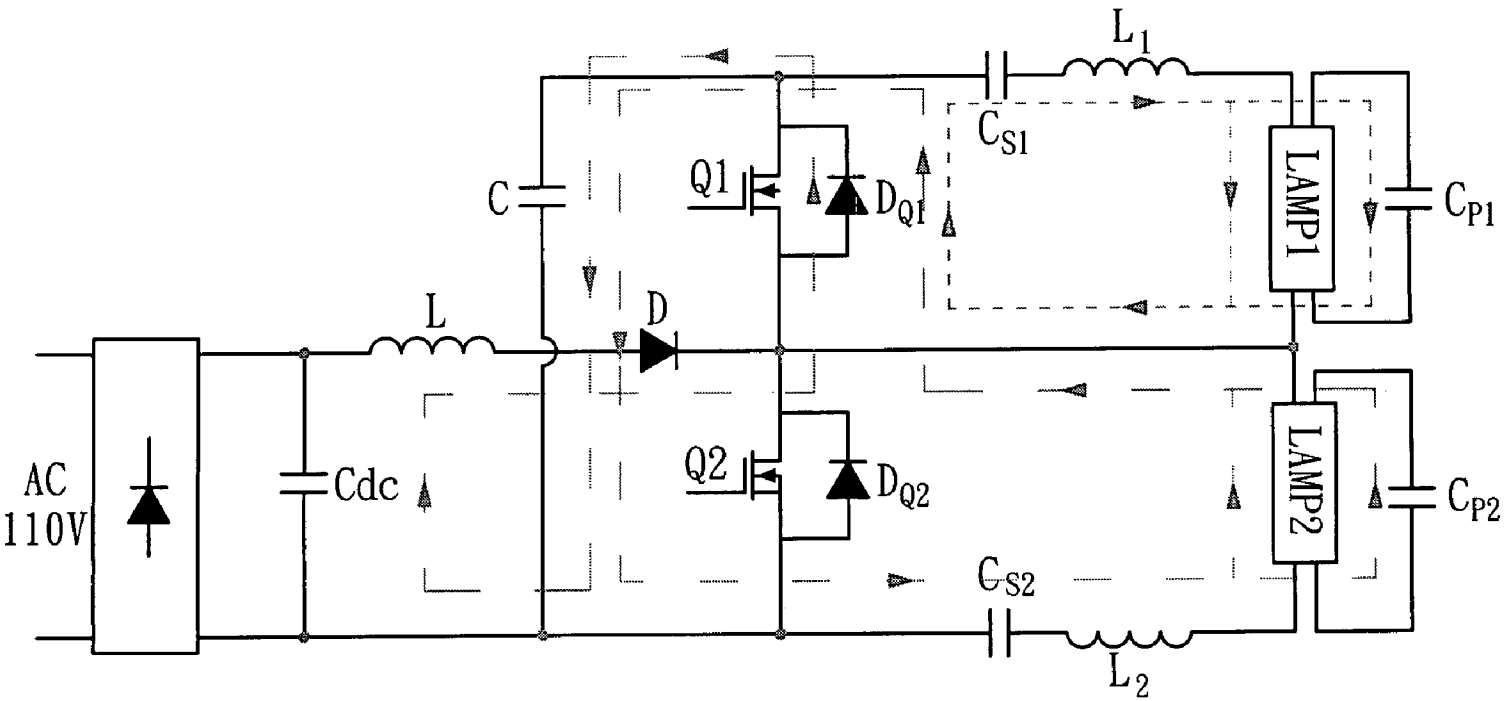
FIG. 8 is a circuit diagram of the invention in working mode 3.

Working mode 3 (t2 to t3):

FIG. 8 is a circuit diagram of the invention in working mode 3. As shown in FIG. 8, the switches Q1 and Q2 are cut off, DQ1 is conductive, and the inductor L begins to charge the capacitor C such that the current flowing through the inductor decreases and the resonant capacitor discharges toward the fluorescent lamp tube.

Power factor circuit: VCdc(+)→L→D→DQ1→C→VCdc(−).

Resonant circuit 1: CS1→L1→(Lamp 1//CP1)→DQ1.

Resonant circuit 2: VC(−)→CS2→L2→(Lamp 2//CP2)→DQ1→VC(+).

Figure 9:
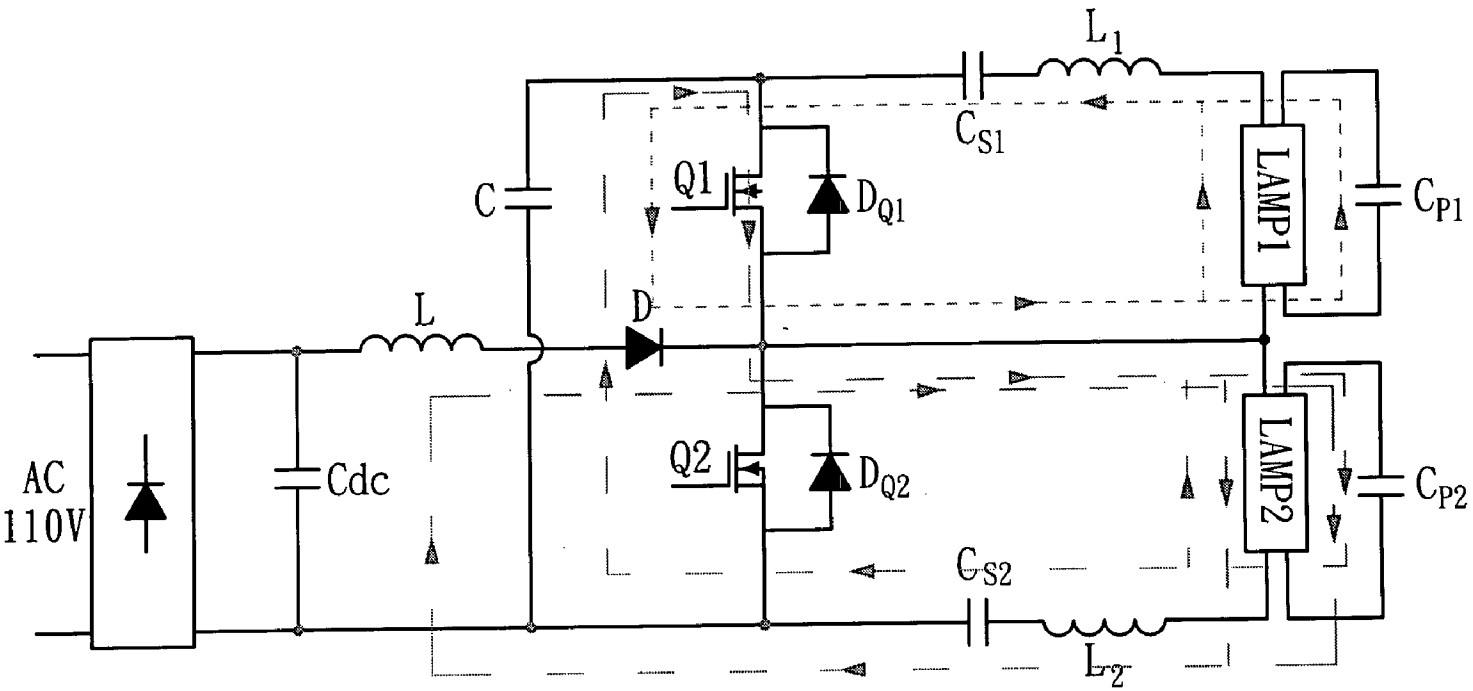
FIG. 9 is a circuit diagram of the invention in working mode 4.

Working mode 4 (t3 to t5):

FIG. 9 is a circuit diagram of the invention in working mode 4. As shown in FIG. 9, the switch Q1 is conductive, the capacitor discharges toward the lower arm resonant circuit and the DC capacitor also discharges toward the lower arm resonant circuit. Thus, the current of the resonant circuit increases.

Power factor circuit: VCdc(+)→L→D→(Lamp 2//CP2)→L2→CS2→VCdc(−).

Resonant circuit 1: CS1→Q1→(Lamp 1//CP1) L1.

Resonant circuit 2: VC(+)→Q1→(Lamp 2//CP2)→L2→CS2→VC(−).

Figure 10:
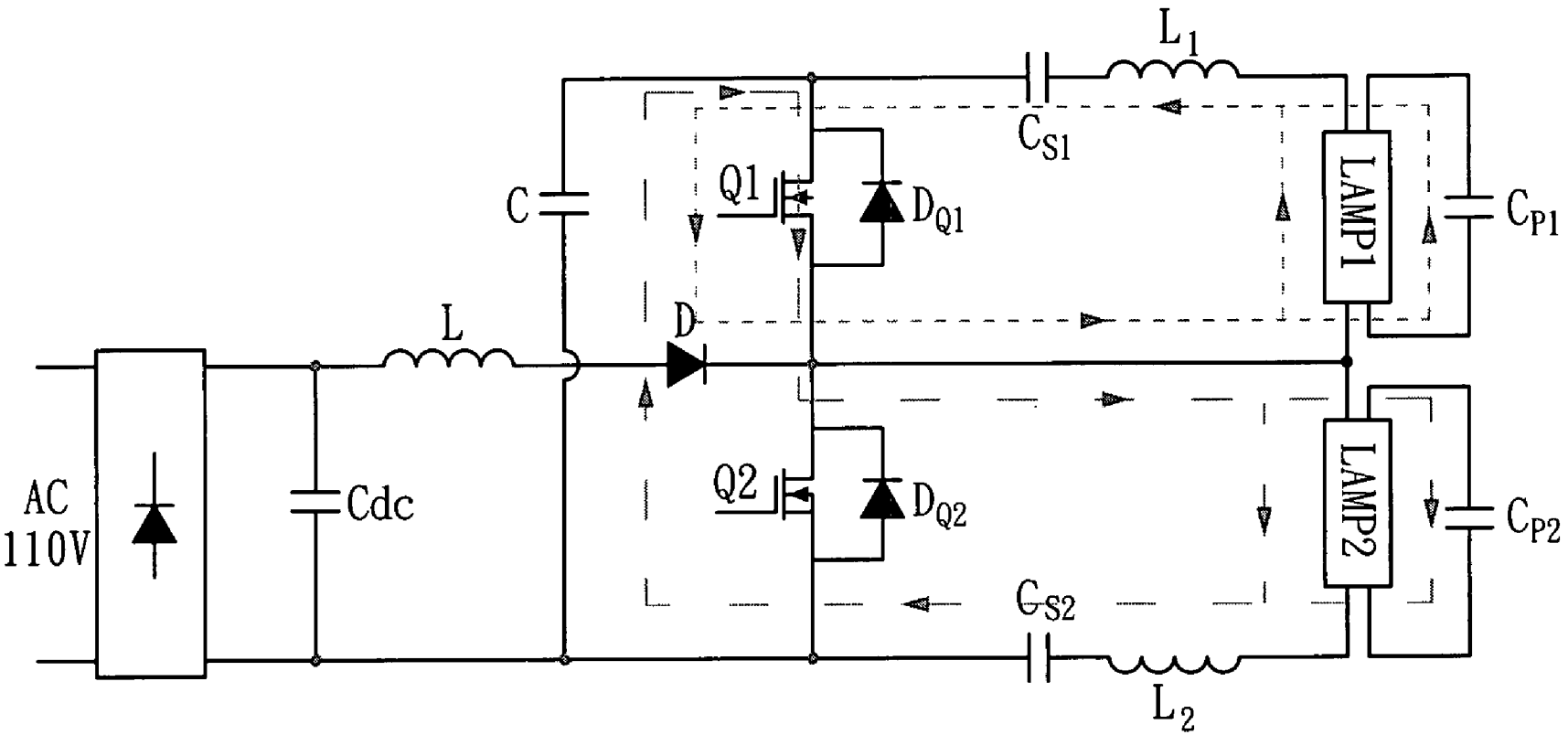
FIG. 10 is a circuit diagram of the invention in working mode 5.

Working mode 5 (t5 to t6):

FIG. 10 is a circuit diagram of the invention in working mode 5. As shown in FIG. 10, since the operation of the inductor current is in a discontinuous mode, there is no inductor current at this time and the resonant circuit discharges toward the fluorescent lamp tube.

Resonant circuit 1: CS1→Q1→(Lamp 1//CP1)→L1.

Resonant circuit 2: VC(+)→Q1→(Lamp 2//CP2)→L2→CS2→VC(−).

Figure 11:
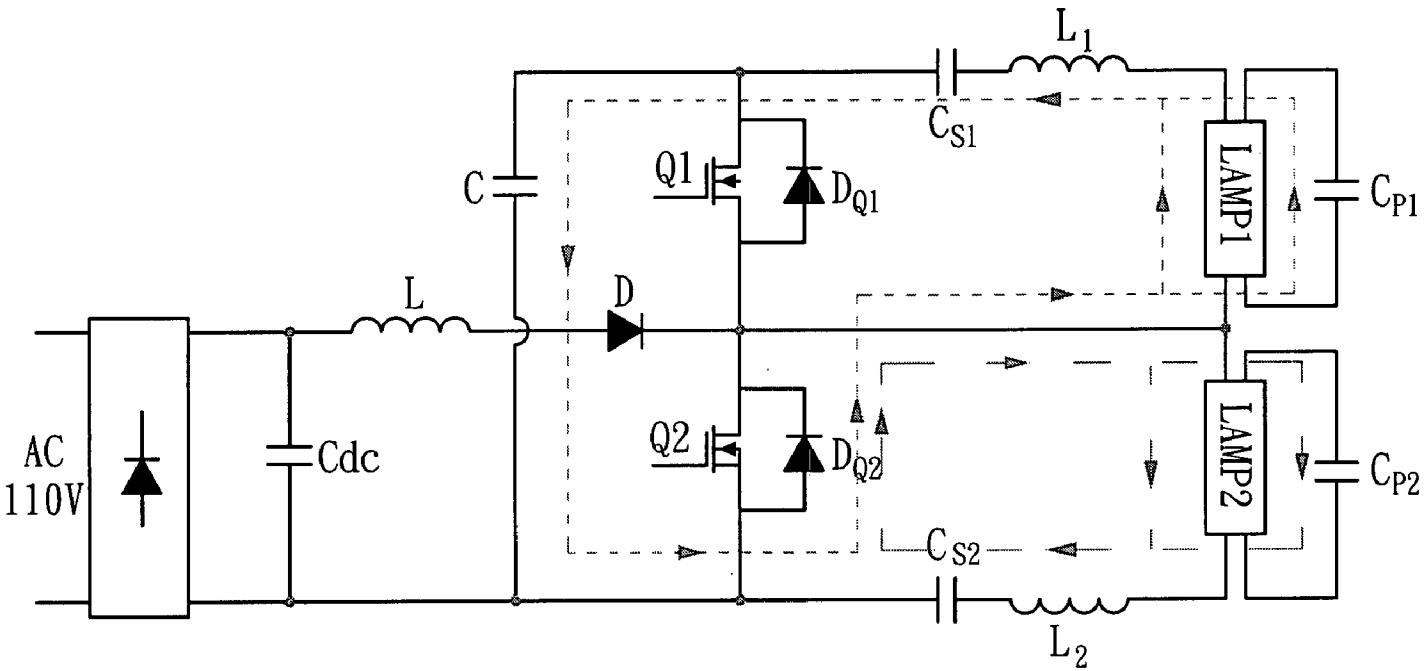
FIG. 11 is a circuit diagram of the invention in working mode 6.

Working mode 6 (t6 to t7):

FIG. 11 is a circuit diagram of the invention in working mode 6. As shown in FIG. 11, the switches Q1 and Q2 are cut off, DQ2 is conductive and at this time, the resonant capacitor discharges toward the fluorescent lamp tube.

Resonant circuit 1: VC(−)→DQ2→(Lamp 1//CP1)→L1→CS1→VC(+).

Resonant circuit 2: CS2→DQ2→(Lamp 2//CP2)→L2.

It can be seen from the above that since the invention integrates the conventional two-stage electronic ballast for a fluorescent lamp into a single-stage electronic ballast for a fluorescent lamp, it can effectively save the number of the switch elements to accomplish the objective of simplifying the circuit and thus to solve the problems of complicated circuit, big switching loss and low efficiency encountered in the conventional techniques.

The above-mentioned embodiments are exampled merely for convenience of interpretation. The scope of the claims of the invention should be based on what is described in the claims, but not limited to the above-mentioned embodiments.

What is claimed is:

1. A single-stage electronic ballast for a fluorescent lamp, comprising:

a boost circuit, including a first inductor, a first capacitor, a first diode and at least a switch, the positive terminal of the first diode being connected to the first inductor, the negative terminal of the first diode being connected to the at least a switch; and at least a load unit, including at least a fluorescent lamp, two terminals of the first capacitor being connected to the at least a load unit, the at least a switch being connected to the at least a load unit for controlling its turning-on and turning-off, wherein the at least a load unit comprises a fluorescent lamp tube, a second capacitor and a second inductor, and the positive terminal of the second capacitor is connected to the at least a switch and the negative terminal of the second capacitor is connected to the second inductor, and wherein the boost circuit and the at least a load unit share the at least a switch.

2. The single-stage electronic ballast for a fluorescent lamp as claimed in claim 1, wherein one terminal of the fluorescent lamp tube is connected to the second inductor and the other terminal of the fluorescent lamp tube is connected to the at least a switch.

3. The single stage electronic ballast for a fluorescent lamp as claimed in claim 1, wherein the at least a switch is connected to a half-bridged, pulse width modulation controller and the half-bridged, pulse width modulation controller produces a pulse width modulation signal to control the at least a switch.

4. The single-stage electronic ballast for a fluorescent lamp as claimed in claim 1, wherein the at least a switch is a transistor switch.

5. The single-stage electronic ballast for a fluorescent lamp as claimed in claim 4, wherein the transistor switch is a Metal Oxide Semiconductor Field-Effect Transistor.

6. A single-stage electronic ballast for a fluorescent lamp, comprising:

a boost circuit, including a first inductor, a first capacitor, a first diode and at least a switch, the positive terminal of the first diode being connected to the first inductor, the negative terminal of the first diode being connected to the at least a switch; and at least a load unit, including at least a fluorescent lamp, two terminals of the first capacitor being connected to the at least a load unit, the at least a switch being connected to the at least a load unit for controlling its turning-on and turning-off, wherein the at least a load unit comprises a fluorescent lamp tube, a second capacitor and a second inductor, and one terminal of the second inductor is connected to the second capacitor and the other terminal of the second inductor is connected to the fluorescent lamp tube, and wherein the boost circuit and the at least a load unit share the at least a switch.

7. The single-stage electronic ballast for a fluorescent lamp as claimed in claim 6, wherein one terminal of the fluorescent lamp tube is connected to the second inductor and the other terminal of the fluorescent lamp tube is connected to the at least a switch.

8. The single-stage electronic ballast for a fluorescent lamp as claimed in claim 6, wherein the at least a switch is connected to a half-bridged, pulse width modulation controller and the half-bridged, pulse width modulation controller produces a pulse width modulation signal to control the at least a switch.

9. The single-stage electronic ballast for a fluorescent lamp as claimed in claim 6, wherein the at least a switch is a transistor switch.

10. The single-stage electronic ballast for a fluorescent lamp as claimed in claim 9, wherein the transistor switch is a Metal Oxide Semiconductor Field-Effect Transistor.

* * * * *